US008191261B2

(12) United States Patent
Ho

(10) Patent No.: US 8,191,261 B2
(45) Date of Patent: Jun. 5, 2012

(54) ALUMINUM SLEEVE FOR MAGNETIC DEVELOPMENT ROLLER

(75) Inventor: Kam Hung Ho, Hong Kong (CN)

(73) Assignee: SKC Precision Limited, Chai Wan, Hong Kong (CN)

( * ) Notice: Subject to any disclaimer, the term of this patent is extended or adjusted under 35 U.S.C. 154(b) by 1011 days.

(21) Appl. No.: 12/083,179

(22) PCT Filed: Feb. 14, 2006

(86) PCT No.: PCT/CN2006/000149

§ 371 (c)(1),
(2), (4) Date: Apr. 3, 2008

(87) PCT Pub. No.: WO2007/056903

PCT Pub. Date: May 24, 2007

(65) Prior Publication Data

US 2009/0048083 A1 Feb. 19, 2009

(51) Int. Cl.
*B21K 1/02* (2006.01)

(52) U.S. Cl. ..... 29/895.32; 29/895.3; 492/48; 492/54

(58) Field of Classification Search ..... 492/8, 54, 492/48; 29/895.32, 895.3
See application file for complete search history.

(56) References Cited

U.S. PATENT DOCUMENTS

| | | | | | |
|---|---|---|---|---|---|
| 4,331,101 | A * | 5/1982 | Muller et al. | ..... | 399/276 |
| 4,368,971 | A * | 1/1983 | Watanabe et al. | ..... | 399/276 |
| 4,526,130 | A * | 7/1985 | Fukuda et al. | ..... | 399/276 |
| 5,697,029 | A * | 12/1997 | Saitoh et al. | ..... | 399/286 |
| 5,749,033 | A * | 5/1998 | Swartz et al. | ..... | 399/267 |
| 6,157,803 | A * | 12/2000 | Agatsuma | ..... | 399/276 |
| 2003/0110632 | A1 * | 6/2003 | Iwase | ..... | 29/895.32 |

* cited by examiner

*Primary Examiner* — Essama Omgba
(74) *Attorney, Agent, or Firm* — Raymond Y. Chan; David and Raymond Patent Firm

(57) ABSTRACT

An aluminum sleeve for magnetic development rollers includes an aluminum sleeve and a shaft fixed at the ends of the aluminum sleeve for engaging with a gear, wherein an etching absorption layer is arranged on the surface of the aluminum sleeve, and a nickel plating protect layer is arranged onto the etching absorption layer. A manufacture method thereof involves forming an etching absorption layer on the surface of the aluminum sleeve via a chemical texture etching process, then forming a nickel plating protect layer onto the etching absorption layer via a nickel chemical plating process. The etching absorption layer has fine and uniform particles, and the nickel protect layer prevents the etching absorption layer from being oxidized and improves the wear resistance of the aluminum sleeve.

13 Claims, 1 Drawing Sheet

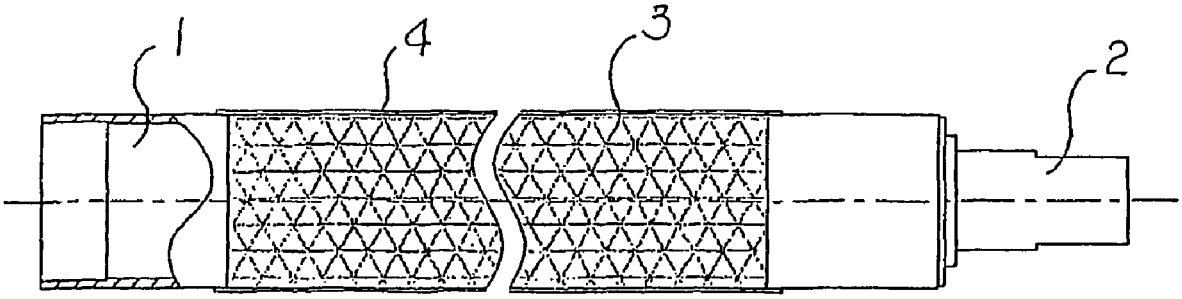
1
4
3
2

ALUMINUM SLEEVE FOR MAGNETIC DEVELOPMENT ROLLER

BACKGROUND OF THE PRESENT INVENTION

1. Field of Invention

The present invention relates to accessories of laser printers, copiers, and fax machines, and more particularly to an aluminum sleeve for magnetic development rollers and its method.

2. Description of Related Arts

The magnetic roller inside the drum is considered as one of the important accessories for a laser printer, copier, and/or a fax machine. The magnetic roller generally comprises an aluminum sleeve having an adsorption layer, a magnetic core received in the aluminum sleeve, a conductive terminal coupled at the end of the aluminum sleeve, and two plastic made insulation covers mounted at two ends of the aluminum sleeve respectively. When the magnetic core generates a magnetic field, the toner (carbon powder) is attached to the absorption layer of the aluminum sleeve. Once the magnetic roller is electrified, the aluminum sleeve transforms the array of the toner to the photoreceptor surface of the imaging drum. Therefore, the printing performance of the machine is directly affected by the quality of the absorption layer of the aluminum sleeve. Accordingly, the magnetic roller is generally constructed by the aluminum sleeve having the absorption layer at its outer surface, and a shaft extended at one end of the aluminum sleeve for gear engagement. However, the two methods have the drawbacks that the absorption layer may attach coarse particles and the particles are unevenly attached on the absorption layer. In addition, the manufacturing process is relatively complicated and the manufacturing cost is relatively expensive. The China patent, from our company 200420051571.X entitled "advance aluminum sleeve for magnetic rollers", teaches the aluminum sleeve has an absorption layer for overcoming the drawbacks of coarse and uneven particles by the conductive coating or sandblasting methods. However, in actual use, the absorption layer of the aluminum sleeve is more easily oxidized and its wearing resistance is poor. The oxidation of the absorption layer will affect the performance of the magnetic roller while the poor wearing resistance of the absorption layer will reduce the service life span of the aluminum sleeve.

SUMMARY OF THE PRESENT INVENTION

A main object of the present invention is to provide an aluminum sleeve for a magnetic roller and its manufacturing method, wherein the aluminum sleeve has an etching absorption layer is adapted for not only preventing the oxidation of the outer surface of the aluminum but also enhancing the wearing resistance of the aluminum sleeve to provide fine and uniform particles on the aluminum sleeve, so as to extend the service life span of the aluminum sleeve.

Accordingly, the present invention provides an aluminum sleeve structure for a magnetic roller, comprises an aluminum sleeve, a shaft securely coupled at one end of the aluminum sleeve for gear engagement, and an etching absorption layer provided on an outer surface of the aluminum sleeve. The aluminum sleeve structure further comprises a nickel protective layer applied (preferably by plating) on the etching absorption layer for protection.

The present invention further provides a method of manufacturing an aluminum sleeve for a magnetic roller, comprising the following steps.

(1) Directly chemical-etch an etching absorption layer on the outer surface of the aluminum sleeve by the chemical texture etching process.

(2) Overlappedly coat a nickel protective layer onto the etching absorption layer by the nickel chemical plating process, wherein the thickness of the nickel protective layer is less than 10 μm.

The aluminum sleeve structure of the present invention provides fine and uniform particles at the aluminum sleeve to enhance the performance of the magnetic roller by overlapping the nickel protective layer on the etching absorption layer. Therefore, the nickel protective layer forms a separation to prevent the etching absorption layer from being contacted with ambient air, so as to prevent the etching absorption layer from being oxidized. In addition, the nickel protective layer has a predetermined hardness to enhance the wear resistance of the etching absorption layer on the aluminum sleeve.

Furthermore, the nickel protective layer is adapted to protectively retain the fine and particles of the etching absorption layer so as to extend the life span of the aluminum sleeve for the magnetic roller.

These and other objectives, features, and advantages of the present invention will become apparent from the following detailed description, the accompanying drawings, and the appended claims.

BRIEF DESCRIPTION OF THE DRAWINGS

FIG. 1 is a schematic view of an aluminum sleeve structure for a magnetic roller according to a preferred embodiment of the present invention.

DETAILED DESCRIPTION OF THE PREFERRED EMBODIMENT

Referring to FIG. 1 of the drawing, an aluminum sleeve structure for a magnetic roller is illustrated, wherein the aluminum sleeve structure provides a fine and uniform particle attachment and a high wearing resistance for the magnetic roller. The aluminum sleeve structure comprises an aluminum sleeve 1 and a shaft 2 securely coupled with an end of the aluminum sleeve 1 for gear engagement. An etching absorption layer 3 is provided on an outer surface of the aluminum sleeve 1. The aluminum sleeve structure further comprises a nickel protective layer 4 overlappedly provided onto the etching absorption layer 3.

The method of manufacturing the aluminum sleeve structure of the present invention comprises the following steps.

(1) Directly chemical-etch the etching absorption layer 3 on the outer surface of the aluminum sleeve 1.

Accordingly, in the step (1), the etching absorption layer 3 is applied on the outer surface of the aluminum sleeve 1 by an etching process which comprises the steps of:

(1a) performing a cleaning process: cleaning the aluminum sleeve 1 by chemically degreasing, washing by water, and clean-processing thereof;

(1b) performing an acid pretreatment process: disposing the cleaned aluminum sleeve 1 into an acidic pretreated solution which comprises 1.3 mole/L of hydrogen ions, 2.4 mole/L of chloride ions from a mixture of hydrochloric acid and ammonium chloride, 0.3 mole/L iron ions and zinc ions, wherein the working temperature of the acidic pretreated solution is set at 50° C. and the treatment time thereof is set for 2 minutes, wherein after the acid pretreatment of the aluminum sleeve 1, a plurality of micro etching pits and a plurality of pointers are provided on the outer surface of the aluminum sleeve 1 in a crowded manner to form a positive charged terminal;

(1c) performing an alkaline roughing treatment process: after the aluminum sleeve 1 is treated by the acid pretreatment process, the aluminum sleeve 1 is washed by water and is then disposed in an alkaline roughing solution for re-etching treatment, wherein the alkaline roughing solution comprises 0.6 mole/L of sodium hydroxide solution, 0.3 mole/L of anhydrous sodium carbonate, and 0.35 mole/L of perchlorate ions and nitrate ions, wherein the working temperature of the alkaline roughing solution is set at 65° C. and the treatment time thereof is set for 2 minutes; and (1d) after the aluminum sleeve 1 is treated by the alkaline roughness treatment process, disposing the aluminum sleeve 1 in a 1:1 nitrate solution for wash-out surface preparation, wherein the aluminum sleeve 1 is then cleaned and dried to form the etching absorption layer 3 on the outer surface of the aluminum sleeve 1.

(2) Overlappedly apply the nickel protective layer 4 onto the etching absorption layer 3. The nickel protective layer 4 is formed on the etching absorption layer 3 by the process comprising the steps of:

(2a) chemically degreasing the aluminum sleeve 1 by using medical sodium hydroxide, anhydrous sodium carbonate, OP-09, sodium silicate, wherein the working temperature is set at 30-40° C. and the treatment time thereof is set for 2 minutes, then the aluminum sleeve 1 is washed by water;

(2b) pickling: using medical nitric acid to treat the aluminum sleeve 1, wherein the working temperature is set at room temperature and the treatment time is set between 20 and 40 seconds, and washing the aluminum sleeve 1 by purified water;

(2c) preliminary dip: using medical sodium hydroxide, zinc oxide, ferric chloride, and sodium tartrate to treat the aluminum sleeve 1, wherein the working temperature is set at room temperature and the treatment time is set between 5 and 20 seconds, and washing the aluminum sleeve 1 by purified water;

(2d) chemical nickel coating: using medical nickel sulphate, sodium acetate, sodium citrate, and sodium hypophosphite to treat the aluminum sleeve 1, wherein the working temperature is set at 85-95° C. and the treatment time is set at 25 minutes, and washing the aluminum sleeve 1 by purified water and drying the aluminum sleeve 1; and (2e) controlling the thickness of the nickel protective layer being less than 10 μm.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of manufacturing an aluminum sleeve for a magnetic roller, comprising the steps of:

(a) directly chemical-etch an etching absorption layer on an outer surface of an aluminum sleeve by chemical texture etching process; and (b) overlappedly coating a nickel protective layer onto said etching absorption layer, wherein the thickness of said nickel protective layer is less than 10 μm;

wherein the step (a) further comprises the steps of:

(a.1) performing a cleaning process of said aluminum sleeve to clean said aluminum sleeve by chemically degreasing, washing by water, and clean-processing thereof;

(a.2) performing an acid pretreatment process by disposing said cleaned aluminum sleeve into an acidic pretreated solution, wherein after said acid pretreatment of said aluminum sleeve, a plurality of micro etching pits and a plurality of pointers are provided on said outer surface of said aluminum sleeve in a crowded manner to form a positive charged terminal, wherein a working temperature of said acidic pretreated solution is set at 50° C. and a treatment time thereof is set for 2 minutes;

(a.3) performing an alkaline roughing treatment process, wherein after said aluminum sleeve is treated by said acid pretreatment process, said aluminum sleeve is washed by water and is then disposed in an alkaline roughing solution for re-etching treatment, wherein a working temperature of the alkaline roughing solution is set at 65° C. and a treatment time thereof is set for 2 minutes; and (a.4) after said aluminum sleeve is treated by said alkaline roughness treatment process, disposing said aluminum sleeve in a 1:1 nitrate solution for wash-out surface preparation, wherein said aluminum sleeve is then cleaned and dried to form said etching absorption layer on said outer surface of said aluminum sleeve.

2. The method as recited in claim 1 wherein, in the step (a.2), said acidic pretreated solution comprises 1.3 mole/L of hydrogen ions, 2.4 mole/L of chloride ions from a mixture of hydrochloric acid and ammonium chloride, 0.3 mole/L iron ions and zinc ions.

3. The method as recited in claim 2 wherein, in the step (a.3), said alkaline roughing solution comprises 0.6 mole/L of sodium hydroxide solution, 0.3 mole/L of anhydrous sodium carbonate, and 0.35 mole/L of perchlorate ions and nitrate ions.

4. The method, as recited in claim 3, wherein the step (b) further comprises the steps of:

(b.1) chemically degreasing said aluminum sleeve by using medical sodium hydroxide, anhydrous sodium carbonate, OP-09, sodium silicate, and then washing said aluminum sleeve by water;

(b.2) pickling said aluminum sleeve by using medical nitric acid to treat said aluminum sleeve, and washing said aluminum sleeve by purified water;

(b.3) preliminary dip of said aluminum sleeve by using medical sodium hydroxide, zinc oxide, ferric chloride, and sodium tartrate to treat said aluminum sleeve, and washing said aluminum sleeve by purified water;

(b.4) chemical nickel coating to said aluminum sleeve by using medical nickel sulphate, sodium acetate, sodium citrate, and sodium hypophosphite to treat said aluminum sleeve, washing said aluminum sleeve by purified water, and drying said aluminum sleeve; and (b.5) controlling the thickness of said nickel protective layer being less than 10 μm.

5. The method as recited in claim 4 wherein, in the step (b.1), wherein a working temperature of said chemically degreasing said aluminum sleeve is set at 30-40° C. and a treatment time thereof is set for 2 minutes.

6. The method as recited in claim 5 wherein, in the step (b.2), wherein a working temperature of said pickling is set at room temperature and a treatment time thereof is set between 20 and 40 seconds.

7. The method as recited in claim 6 wherein, in the step (b.3), wherein a working temperature of said preliminary dip is set at room temperature and a treatment time thereof is set between 5 and 20 seconds.

8. The method as recited in claim 7 wherein, in the step (b.4), wherein a working temperature of said chemical nickel coating is set at 85-95° C. and a treatment time thereof is set at 25 minutes.

9. The method, as recited in claim 1, wherein the step (b) further comprises the steps of:

(b.1) chemically degreasing said aluminum sleeve by using medical sodium hydroxide, anhydrous sodium carbonate, OP-09, sodium silicate, and then washing said aluminum sleeve by water;

(b.2) pickling said aluminum sleeve by using medical nitric acid to treat said aluminum sleeve, and washing said aluminum sleeve by purified water;

(b.3) preliminary dip of said aluminum sleeve by using medical sodium hydroxide, zinc oxide, ferric chloride, and sodium tartrate to treat said aluminum sleeve, and washing said aluminum sleeve by purified water;

(b.4) chemical nickel coating to said aluminum sleeve by using medical nickel sulphate, sodium acetate, sodium citrate, and sodium hypophosphite to treat said aluminum sleeve, washing said aluminum sleeve by purified water, and drying said aluminum sleeve; and (b.5) controlling the thickness of said nickel protective layer being less than 10 μm.

10. The method as recited in claim 9 wherein, in the step (b.1), wherein a working temperature of said chemically degreasing said aluminum sleeve is set at 30-40° C. and a treatment time thereof is set for 2 minutes.

11. The method as recited in claim 9 wherein, in the step (b.2), wherein a working temperature of said pickling is set at room temperature and a treatment time thereof is set between 20 and 40 seconds.

12. The method as recited in claim 9 wherein, in the step (b.3), wherein a working temperature of said preliminary dip is set at room temperature and a treatment time thereof is set between 5 and 20 seconds.

13. The method as recited in claim 9 wherein, in the step (b.4), wherein a working temperature of said chemical nickel coating is set at 85-95° C. and a treatment time thereof is set at 25 minutes.

* * * * *